United States Patent [19]

MacFarlane

[11] 4,178,656

[45] Dec. 18, 1979

[54] GLIDE FOR DRAPERY TRAVERSE ROD

[75] Inventor: Walter J. MacFarlane, Kensington, Conn.

[73] Assignee: The Stanley Works, New Britain, Conn.

[21] Appl. No.: 968,266

[22] Filed: Dec. 11, 1978

[51] Int. Cl.[2] ..... A47H 15/00

[52] U.S. Cl. ..... 16/93 D; 16/95 D; 24/221 R; 248/222.3

[58] Field of Search ..... 16/93 R, 93 D, 94 R, 16/94 D, 95 R, 95 D, 96 R, 96 D, 87.2; 24/206, 221 R; 160/345; 248/222.2, 222.3, 307

[56] References Cited

U.S. PATENT DOCUMENTS

| | | | |
|---|---|---|---|
| 2,848,735 | 8/1958 | Ault et al. | 16/93 D |
| 2,872,696 | 2/1959 | Perlmutter | 16/93 D X |
| 3,199,142 | 8/1965 | Salzmann et al. | 16/87.2 |
| 3,262,148 | 7/1966 | Saltz | 16/93 D X |
| 3,337,903 | 8/1967 | Kenney | 160/345 X |
| 3,359,592 | 12/1967 | Saltz | 16/93 D |
| 3,378,879 | 4/1968 | Stall | 16/93 D X |

FOREIGN PATENT DOCUMENTS

| | | | |
|---|---|---|---|
| 1112265 | 8/1961 | Fed. Rep. of Germany | 248/222.3 |
| 2401686 | 7/1975 | Fed. Rep. of Germany | 16/93 D |

*Primary Examiner*—Werner H. Schroeder
*Assistant Examiner*—Moshe I. Cohen
*Attorney, Agent, or Firm*—Prutzman, Kalb, Chilton & Alix

[57] ABSTRACT

A drapery hook support glide is designed to be mountable on a traverse rod at any location along the length of the rod. It is provided with a rod engaging head portion having a longitudinal dimension greater than the width of the track slot in the rod to assure retentive engagement with the rod when the glide is in a vertical position and a transverse dimension that is less than the width of the track slot to permit easy mounting of the glide in a horizontal position. Additionally, the neck portion of the glide is provided with side flanges for engaging the track upon sidewise rotation of the glide out of its vertical position thereby preventing inadvertent movement into its horizontal position with the glide pendant aligned with the track slot.

10 Claims, 7 Drawing Figures

GLIDE FOR DRAPERY TRAVERSE ROD

BACKGROUND AND SUMMARY OF THE INVENTION

The present invention relates generally to a glide of the type that is mounted for slidable movement along a drapery rod track or the like. More particularly, it relates to a drapery hook support glide used on tracks typically located in the rear of a drapery rod such as a traverse rod for supporting the drapery along the top hem or heading thereof.

When hanging a drapery using hooks that are mounted on slidable glides, it frequently occurs that either a glide is missing or inconveniently located or excess glides are present along the length of the drapery. In such situations, it is typically necessary or desirable either to add or remove glides from the track. To do so usually requires that the drapery be taken down since the glides must be unfastened from the drapery and passed through the end of the rod to be removed from or added to the track. Additionally, traverse rods in use today frequently contain means on the rod to prevent the glides from accidentally falling out of the end of the rod thereby making the addition or subtraction of a glide from the traverse rod a substantial and sometimes, frustrating problem.

Although some glide structures have been found in the prior art which permit the insertion and removal of a glide at an intermediate point along the length of the rod, these structures typically have required that the glide be tilted toward the wall and held in that tilted position as the user attempts to hook the retaining head of the glide onto the track. Such structures can be found in U.S. Pat. Nos. 2,872,696 and 3,199,142. Since the track usually is located in the rear of the rod and the narrow space between the rod and the wall prevents easy viewing of the track and glide head, the tilting manipulation of the glide toward the wall further restricts the usuable space making it even more difficult to hook the retaining head or button of the glide within the track. Additionally, in structures such as that described in U.S. Pat. No. 3,199,142, the glide is free to swing from side to side as the drapery is moved longitudinally along the traverse rod permitting the glides to jam within the track.

It is an object of the present invention to provide a substantially simplified design for a drapery hook support glide that can be easily and rapidly mounted on the track of a traverse rod or the like at any location along the length of the rod. Included in this object is the provision for a glide that need not be tilted toward the wall in order to insert the button or head portion thereof within the track and permits mounting of the glide even when the traverse rod is located in a position very close to the wall.

Another object of the present invention is to provide a new and improved glide of the type described that prevents the glide from swaying substantially from side to side and resists movement to a position that would permit accidental release of the glide from the traverse rod. Included in this object is the provision for a glide of the type described that not only prevents accidental release but, at the same time, permits rapid and facile mounting and dismounting of the glide from the track intermediate the ends of the rod, in a simple and efficient manner.

Other objects will be in part obvious and in part pointed out more in detail hereinafter.

These and related objects are accomplished in accordance with the present invention by providing a drapery hook support glide of the type described wherein the rod engaging head portion of the glide is of an elongated configuration, that is, it is provided with a longitudinal dimension that is greater than the width of the track slot to assure retentive engagement of the head with the interior of the rod when the body portion of the glide is in a vertical position yet at the same time is provided with a transverse dimension that is less than the width of the track slot to permit easy passage of the head therethrough when the body portion of the glide is in a horizontal position. Additionally, the neck portion of the glide that connects the head to the body portion is provided with interference means for engaging the track upon movement of the body portion out of the vertical position. Such means resist inadvertent movement of the glide into the horizontal position that permits removal of the glide and thereby prevents accidental release of the glide from the rod. The interference means also provides a limitation on the side to side swinging action of the glide; however, the interference means is such that it permits rapid mounting of the glide on the track intermediate the ends of the rod when the body portion of the glide is in its horizontal position.

A better understanding of the invention will be obtained from the following detailed description and the accompanying drawings of illustrative applications of the invention.

DESCRIPTION OF THE PREFERRED EMBODIMENTS

Figure 1:
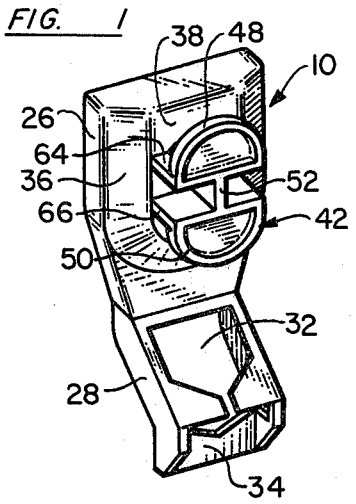
FIG. 1 is an enlarged perspective view of a drapery hook support glide embodying the features of the present invention.
Figure 2:
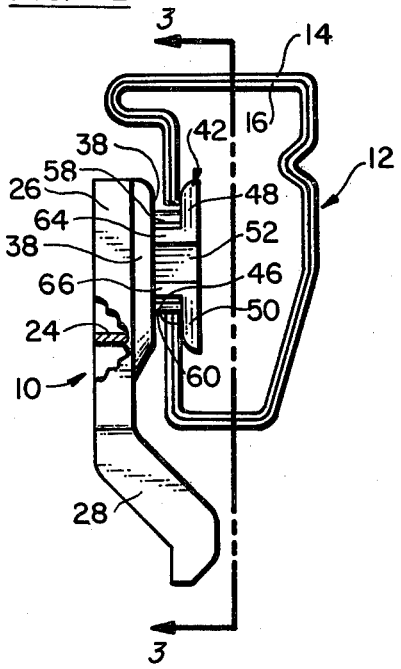
FIG. 2 is a side view, partially broken away, of the glide of FIG. 1 mounted on a traverse rod.
Figure 3:
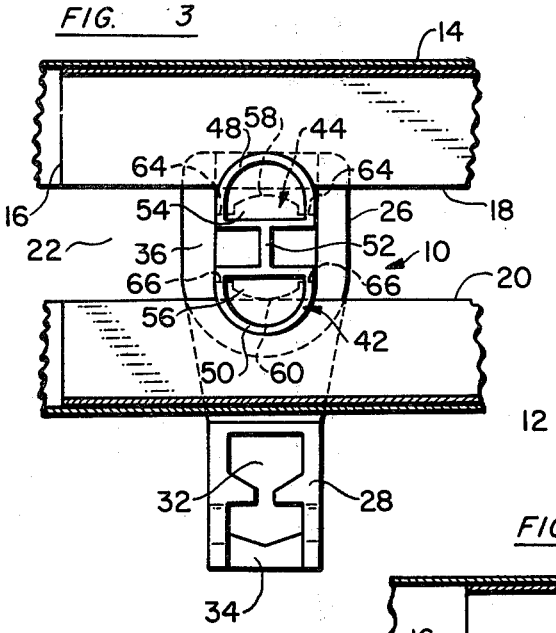
FIG. 3 is a view taken along the line 3—3 of FIG. 2.

Referring now to the drawings in greater detail, wherein like reference numerals indicate like parts throughout the several figures, there is shown in the first five figures a drapery hook support glide 10 that can be easily mounted on or removed from a drapery rod when in its horizontal position (FIG. 5) but which is securely mounted on the track when in its vertical position (FIGS. 2 and 3). In the embodiment illustrated a traverse rod 12 is depicted having telescoping sections 14, 16 that provide a rear wall having top and bottom rails 18, 20 that collectively define a slotted track 22 in the rear wall of the traverse rod. The glide 10, which is preferably made of a plastic material such as high density polyethylene, nylon, teflon, or the like, may be a solid member but in the illustrated embodiments is shown as a light weight shell structure with reinforcing ribs 24 to provide sufficient structural stability. The glide 10 is a generally rectangular member consisting of a main upper body portion 26 of elongated configuration tapering toward an integrally secured lower pendant portion 28 depending from one end thereof. The pendant portion 28 is suitably apertured at 32 and inclines forwardly toward its free end where a notched support cross bar 34 is provided for mountably receiving and supporting a drapery hook (not shown). The enlarged body portion 26 of the glide 10 is provided with a forwardly projecting raised platform 36 terminating in a substantially flat elongated platform surface 38, with the major dimension of the surface 38 extending longitudinally along the elongated plastic glide.

A rod engaging button or head portion, generally designated 42, is integrally connected to the raised platform 36 by means of a neck portion 44 and is disposed in substantially parallel spaced relationship to the flat elongated platform surface 38. As shown, the rod engaging head portion 42 has length and width dimensions essentially equal to the length and width dimensions of the platform surface 38 and provides a flat rearwardly facing rod engaging surface 46 in spaced confronting relationship to the flat platform surface 38. Those confronting surfaces and the neck portion 44 define a notch for receiving the lower rail 20 of the traverse rod. As can be readily seen, the elongated head portion 42 may consist of top and bottom semicircular segments 48, 50, respectively, that are spaced to provide an effective overall elliptical configuration. In the embodiment illustrated in FIGS. 1–5 the semicircular head portion segments 48, 50 are interconnected by a vertical stabilizing rib 52 and are secured to the main body portion 26 of the glide by corresponding top and bottom neck segments 54, 56 that are also interconnected by the vertically extending rib 52. The top and bottom neck segments 54, 56 are provided with arcuate top and bottom bearing surfaces 58, 60, respectively, that, as best shown in FIG. 3, are spaced from each other by a distance equal to slightly less than the width of the track slot 22. Accordingly, in use the bottom arcuate bearing surface 60 will rest on the bottom guide rail 20 of the track slot 22 while the top surface 58 is spaced slightly from the top rail 18 of the track slot to permit free sliding movement of the glide along the length of the track.

As mentioned, the spaced top and bottom head segments 48, 50 provide the head with an effective length substantially equal to the length of the flat platform surface 38. As best seen in FIGS. 2 and 3, this length is substantially greater than the width of the track slot 22 so that the longitudinal end portions of the head segments 48, 50 extend respectively above and below the track slot 22 when the glide 10 is disposed in a vertical position, thereby preventing the glide from becoming dislodged from the traverse rod during normal operation.

Figure 5:
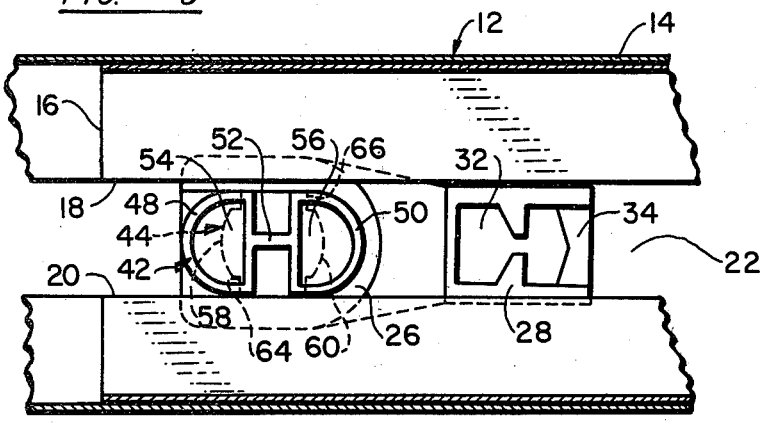
FIG. 5 is a view similar to FIGS. 3 and 4 illustrating the glide in a position for mounting or dismounting on the track of the traverse rod.

In accordance with the present invention the neck and head portions 42, 44 of the glide have a transverse dimension or width that is slightly less than the width of the track slot 22 such that when the glide is in a horizontal position, as shown in FIG. 5, the head and neck portions 42, 44 readily pass through the track slot 22 permitting the back wall of the rod 12 to come into engagement with the main body portion 26 of the glide 10. As shown, the body portion has a transverse dimension that is substantially greater than the width of the track slot and the lower pendant portion 28 is slightly wider than the slot thereby preventing inadvertent full insertion of the glide into the interior of the rod.

Figure 4:
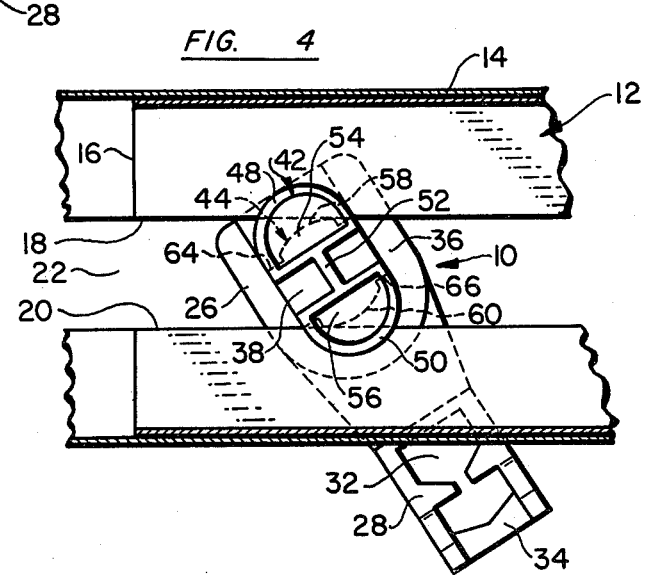
FIG. 4 is a view similar to FIG. 3 showing the position of the drapery hook support glide when rotated within the track to an interference position.

In the preferred structure the glide is further provided with neck members that interfere with the inadvertent movement of the glide from its mounted vertical position to a dismountable horizontal position. In the specific embodiment illustrated the interference members take the form of a pair of transversely extending flanges 64, 66 projecting outwardly from opposite sides of the top and bottom bearing surfaces 58, 60. Although each of these neck flanges are no greater in length than the transverse dimension of the head, and thus are shorter than the width of the track slot, they are spaced above and below the central axis of the neck and head portions. In that way, the effective diameter or distance between the diagonally opposite free ends of the flanges 64, 66 is greater than the transverse dimension of the head portion and, more importantly, greater than width of the slot 22. Consequently, rotation of the glide 10 within the slot 22 in either sidewise rotational direction will bring the diagonally opposite ends of the flanges into engagement with the top and bottom rails 18, 22 of the track. This cooperative interference blocks further free swinging rotation of the glide away from its vertical position thereby preventing inadvertent rotation of the glide into its horizontal position. This angular interference position of the glide is illustrated in FIG. 4. However, as will be appreciated, the operative interference dimension or diameter of the flanges 64, 66 is only slightly greater than the width of the track slot 22 so that the glide can be forcibly rotated beyond the interference position toward its horizontal position shown in FIG. 5 whereupon the glide can be easily withdrawn from the track slot. In fact, as the glide passes its interference position, the cantilevered pendant portion 28 is distorted slightly by the back of the rod 12 as the glide moves toward its horizontal position. This causes a slight outward biasing force on the head portion 42 assuring a positive release of the head from the track.

Figure 6:
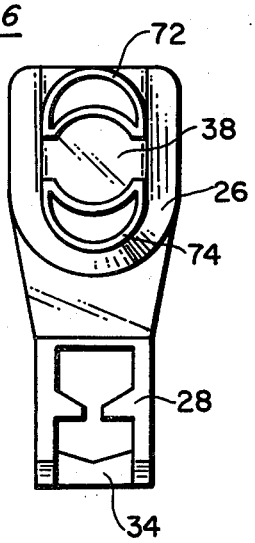
FIG. 6 is a front plan view of another embodiment of a drapery support glide of the present invention.
Figure 7:
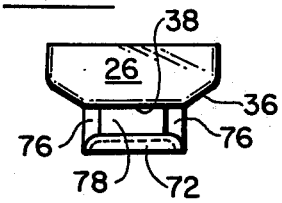
FIG. 7 is a top view of the glide of FIG. 6.

As will be appreciated, the configuration of the interference flanges 64, 66 on the neck portion 44 can be altered so long as the configuration is such as to provide an effective neck diameter slightly greater than the width of the track slot 22 when the glide is rotated out of its normal vertical position. Additionally, the configuration of the neck and head portions may also vary. For example, FIGS. 6 and 7 illustrate a variation in the configuration of the head portion by eliminating the central reinforcing rib and providing head segments 72, 74 of generally crescent shaped configuration rather than the semicircular configuration illustrated in FIG. 1–5. In this embodiment the planar interference flanges 76 also project from each side of the arcuate neck surface 78 on the top neck segment but, as best seen in FIG. 6, do not extend in a planar fashion across the entire width of the head and neck portions. The flanges (not shown) on the bottom neck segment are complimentary to flanges 76.

As will be appreciated from the foregoing detailed description, the glide of the present invention can be readily inserted into the track slot of a traverse rod at any position intermediate the ends of the rod thereby obviating the need to remove the rod from its mounting brackets. Additionally, the glide is securely locked within the track slot when in its normal vertical position and can readily and freely slide along the longitudinal length of the slot. Further the interference flanges projecting from the neck of the glide prevent inadvertent rotation of the glide beyond a preset maximum angular position. However, the interference provided by the flanges nevertheless permits the user to easily rotate the glide further to position the pendant portion of the glide in alignment with the slot for rapid removal of the glide from the traverse rod.

As will be apparent to persons skilled in the art, various modifications, adaptations and variations of the foregoing specific disclosure can be made without departing from the teachings of the present invention.

I claim:

1. A drapery hook support glide for mounting on the slotted track of a drapery rod comprising an upper glide body portion vertically positionable on the exterior of the rod, a head portion positionable within the interior of the rod, a neck portion integrally connecting said body and head portions and positionable within the track slot, and a lower pendant portion for supportably mounting a drapery hook, said pendant portion integrally depending from said upper body portion, said head portion being elongated and having a longitudinal dimension greater than the width of said track slot to provide retentive engagement with the interior of said rod when said body portion is vertically positioned and a transverse dimension less than the width of said slot to permit passage of said head portion therethrough when said body portion is horizontally positioned, said neck portion having interference means thereon for engaging said track upon movement of said body portion out of said vertical position to resist inadvertent movement into said horizontal position and prevent accidental release of said head portion from said rod, said interference means permitting rapid mounting of the glide on the track intermediate the ends of the rod.

2. The glide of claim 1 wherein said interference means include neck members having an operative dimension greater than the width of said track slot and being located on said neck out of engagement with said track when said body portion is vertically positioned on the track.

3. The glide of claim 2 wherein said neck members provide an operative dimension only slightly greater than the width of said track slot to permit forced rotation of the glide between its vertical and horizontal positions.

4. The glide of claim 1 wherein said interference means include flanges extending transversely of the neck portion, said flanges being located so as to be inoperative when the glide is either vertically or horizontally positioned on the track.

5. The glide of claim 1 wherein the neck portion permits sidewise rotation within the track slot about an axis of rotation passing through said neck portion and the interference means includes spaced flanges extending transversely of the neck portion above and below said axis of rotation to provide a collective operative flange diameter greater than the width of the track slot.

6. The glide of claim 1 wherein said head portion has top and bottom end segments extending beyond the top and bottom edges of the track slot when the glide is mounted on the rod in a vertical position.

7. The glide of claim 1 wherein said neck and head portions have substantially the same transverse dimension.

8. The glide of claim 1 wherein the head portion includes top and bottom segments positioned in spaced relationship relative to each other.

9. The glide of claim 8 wherein the neck portion includes top and bottom segments connected respectively to said top and bottom head segments, said interference means including interference members on each neck segment spaced to provide cooperative track engagement upon sidewise rotation by the glide.

10. The glide of claim 9 wherein said interference members are flanges integrally projecting transversely from each neck segment.

* * * * *